US008326628B2

(12) United States Patent
Goldstein et al.

(10) Patent No.: US 8,326,628 B2
(45) Date of Patent: Dec. 4, 2012

(54) METHOD OF AUDITORY DISPLAY OF SENSOR DATA

(75) Inventors: Steven Wayne Goldstein, Delray Beach, FL (US); John Usher, Montreal (CA); John Patrick Keady, Fairfax Station, VA (US)

(73) Assignee: Personics Holdings Inc., Boca Raton, FL (US)

( * ) Notice: Subject to any disclaimer, the term of this patent is extended or adjusted under 35 U.S.C. 154(b) by 0 days.

(21) Appl. No.: 13/012,047

(22) Filed: Jan. 24, 2011

(65) Prior Publication Data

US 2011/0115626 A1 May 19, 2011

Related U.S. Application Data

(63) Continuation of application No. 11/839,991, filed on Aug. 16, 2007, now abandoned.

(60) Provisional application No. 60/822,511, filed on Aug. 16, 2006.

(51) Int. Cl.
*G10L 13/00* (2006.01)
*G10L 11/00* (2006.01)
*G10L 21/00* (2006.01)

(52) U.S. Cl. ..... 704/258; 704/270; 704/274

(58) Field of Classification Search ..... 482/8, 9
See application file for complete search history.

(56) References Cited

U.S. PATENT DOCUMENTS 4,295,472 A 10/1981 Adams
4,933,873 A * 6/1990 Kaufman et al. ..... 704/270
4,981,139 A * 1/1991 Pfohl ..... 600/484
5,438,623 A 8/1995 Begault
5,809,149 A * 9/1998 Cashion et al. ..... 381/17
5,853,351 A 12/1998 Maruo et al.
5,986,200 A * 11/1999 Curtin ..... 84/609
6,145,389 A 11/2000 Ebeling et al.
6,190,314 B1 * 2/2001 Ark et al. ..... 600/300
6,537,214 B1 * 3/2003 Hood et al. ..... 600/300
6,808,473 B2 10/2004 Hisano et al.
7,024,367 B2 * 4/2006 Amano et al. ..... 704/272
7,044,918 B2 5/2006 Diab
2002/0028730 A1 * 3/2002 Kaufman ..... 482/8
2006/0084551 A1 * 4/2006 Volpe, Jr. ..... 482/8
2007/0027000 A1 * 2/2007 Shirai et al. ..... 482/8
2007/0060446 A1 * 3/2007 Asukai et al. ..... 482/8

OTHER PUBLICATIONS

Bronkhorst, "The Cocktail Party Phenomenon: A Review of Research on Speech Intelligibility in Multiple-Talker Conditions", Acustica 86: pp. 117-128, 2000.

Drullman et al., "Multichannel Speech Intelligibility and Talker Recognition Using Monaural, Binaural, and Three-Dimensional Auditory Presentation", J. Acoust. Soc. Am. 107(4), pp. 2224-2235, Apr. 2000.

(Continued)

*Primary Examiner* — Jesse Pullias

(74) *Attorney, Agent, or Firm* — RatnerPrestia

(57) ABSTRACT

A method of auditory communication is provided. The method includes measuring physiological data from at least one sensor to form a data set; identifying a type of the data set; identifying an auditory cue associated with the type of the data set; and generating an auditory notification based on the data set and the auditory cue. The auditory notification indicates at least one of a temporal, spectral, spatial or power characteristic of the data set. The method also includes emitting the auditory notification.

5 Claims, 5 Drawing Sheets

OTHER PUBLICATIONS

Kramer et al., "Sonification Report: Status of the Field and Research Agenda". Report prepared for the National Science Foundation by members of the International Community for Auditory Display (ICAD) 1999.

Martens, "Perceptual Evaluation of Filters Controlling Source Direction: Customized and Generalized HRTFs for Binaural Synthesis", Acoust. Sci & Tech. 24, 5 (2003), pp. 220-232.

U.S. Appl. No. 11/751,259, filed May 21, 2007.

* cited by examiner

METHOD OF AUDITORY DISPLAY OF SENSOR DATA

CROSS-REFERENCE TO RELATED APPLICATIONS

This application is a continuation of U.S. patent application Ser. No. 11/839,991 filed Aug. 16, 2007, now abandoned which claims the benefit of U.S. provisional patent application No. 60/822,511 filed on 16 Aug. 2006. The disclosure of each of the foregoing applications is incorporated herein by reference in its entirety.

FIELD OF THE INVENTION

The present invention relates to the auditory display of biometric data, and more specifically, though not exclusively, is related to prioritizing auditory display of biometric data in accordance with priority levels.

BACKGROUND OF THE INVENTION

Our society is becoming increasingly health conscious and products relating to fitness are becoming increasingly popular. As such, there exists a large body of related art relating to fitness aid devices coupled to biofeedback technology. For example, there are currently devices that use a wrist-watch-type monitor to inform the user, through an audible beep signal or display screen, when their heart rate is in a target zone, ideal for aerobic exercise. This target zone calculation is based on the output of a heart rate monitor, the user's age and gender. Many of these devices include a chest belt that contains a heart rate sensor. These belts can be cumbersome and uncomfortable for the user. They also require some form of perspiration to operate reliably, as the sensor needs a conductive process to detect the heartbeat on the surface of the epidermis.

There are also wrist-watch-type fitness aid devices that detect the heart rate using a sensor attached to the user's finger or directly to the user's forearm (U.S. Pat. No. 4,295,472). Such devices do not require the end-user to wear a chest-belt sensor. However, the user must view the device on his wrist or rely on vague audio cues to read any pertinent physiological data, which would be impractical in many exercise scenarios (i.e. running or jogging). Furthermore, wrist-based audio systems generate relatively low-sound-pressure-level audio cues that easily can be masked, rendering them inaudible in many exercise environments. The user is thus forced to view the wristwatch in order to determine how they are performing during their exercise program. Also, wristwatches can become damaged and lose some of their visual display clarity, thus compromising their usefulness.

Many methods exist for monitoring the physiological attributes of a user under normal conditions, under distress, and in other states of homeostasis. Advances in the noninvasive detection and analysis of cardiovascular and respiratory patterns in living subjects provide a variety of cost-effective, efficient options for measuring physiological data. Examples include non-invasive ultrasound techniques, which have been developed to accurately measure blood flow. Pulse oximetry technology provides a simple method for monitoring the oxygenation of a patient's blood by simply attaching a device to the fingertip or earlobe of the user.

Similarly, photoplethysmography (PPG) sensors use visible or near-infrared radiation and the resulting scattered optical signal levels to monitor the blood flow waveforms, which can be transformed into heart rate data. PPG devices are typically attached to the patient's lobule (earlobe) or fingertip (U.S. Pat. No. 7,044,918). These devices are effective, inexpensive, and reliable under most circumstances. Furthermore, they do not rely on conduction and as such are far more practical for exercise.

PPG devices provide an appropriate means for implementing pulse wave detection and heart rate monitoring. Furthermore, one of the most practical areas of the human body to place a PPG sensor is near the lobule (earlobe).

A wide variety of methods for converting physiological data into meaningful information relevant to personal fitness have been developed. These include calculations of caloric burn data from heart rate data, pedometer data, or other physiological data. Also, the calculation of a target heart rate zone or zones is widely implemented in fitness aid devices. Such calculations are usually based on averages corresponding to an individual's age and often gender, although more sophisticated methods exist as well (U.S. Pat. No. 5,853,351).

Further related art discusses a system similar to the present invention that requires fitting of a sensor in the ear of the user (U.S. Pat. No. 6,808,473). However, this is a more impractical approach, requiring a setup process to align the sensor's optics with the superficial temporal artery to allow detection of the user's pulse waveform.

Several hearing aid companies have developed behind-the-ear (BTE) devices, and have a history in the hearing aid community of robustness and stability under many forms of physical exercise without the BTE unit detaching and falling away from the user's ear.

For many people, exercise is not enjoyable. These people do not exercise as a routine part of their daily lives. Since they do not enjoy it, they tend not to be compliant. In response, music has often been used to motivate and energize people while exercising. Since the introduction of aerobic dance in the early 1970's, it has generally been regarded that music accompaniment to exercise provides significant beneficial effects to the exercise experience. Although the relationship between physiological benefits and music is not necessarily supported by rigorous scientific study, the perceived benefits and motivational benefits are confirmed by simply observing a typical health club environment. In the health club, many individuals chose to wear earphones and upbeat music is often played over the loudspeaker system. Also, music selection is considered paramount in a wide variety of exercise classes. The physiological benefits of the addition of music to exercise scenarios might not be scientifically proven, however the motivational benefits are obvious.

It should be noted that not all exercise is good. Too much exercise can be unhealthy. The appropriate intensity and duration of exercise vary with age, physical strength, and level of fitness. In addition, for those engaged in self-monitored exercise programs recommended by physical therapists, there is a particular need for feedback regarding the extent to which individuals should push themselves.

Related art suggests that an appropriate method of informing an individual about their appropriate level of exercise relates to the AT (anaerobic threshold) value. Technically, the AT is the exercise intensity at which lactate starts to accumulate in the blood stream. Ideal aerobic exercise is generally considered to be around 80% of the AT value. Accurately measuring the AT involves taking blood samples during a ramp test where exercise intensity is progressively increased. Generally, in a consumer fitness aid device the AT value is measured using a less accurate but more practical method. Instead of blood samples, the device reads and analyzes the user's pulse wave during a ramp test (U.S. Pat. No. 6,808,473).

SUMMARY OF THE INVENTION

At least one exemplary embodiment is directed to a method of auditory communication, where at least one data set is measured, where the type of the data set is identified, where the auditory cue associated with the type of data set is obtained; where an auditory notification is generated; and where the auditory notification is emitted.

At least one exemplary embodiment is directed to a device that is implemented in a pair of contained devices that are physically mounted over each ear, coupled to a lobule, and used to propagate auditory stimuli to the user's ear canal.

At least one exemplary embodiment is directed to a behind-the-ear (BTE) device, which can facilitate alignment of the physiological data sensors, mitigating the need for an end-user setup process. Additionally, the Lobule is also void of many nerve endings; as such it is an ideal location for light pressure to be tolerated easily when a PPG sensor is attached there by a system in which the Lobule is sandwiched between two small components of the sensor. Here again, this provides for a more resilient physical attachment to the users ear.

At least one exemplary embodiment supports the integration of audio playback devices such as personal media players as well, providing the end-user with the motivational benefits of music and the practical benefits of biofeedback at the same time. Additionally at least one exemplary embodiment supports a wide variety of physiological data monitoring devices.

Further areas of applicability of exemplary embodiments of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

Exemplary embodiments of present invention will become more fully understood from the detailed description and the accompanying drawings, wherein.

DETAILED DESCRIPTION OF EXEMPLARY EMBODIMENTS OF THE PRESENT INVENTION

Figure 1:
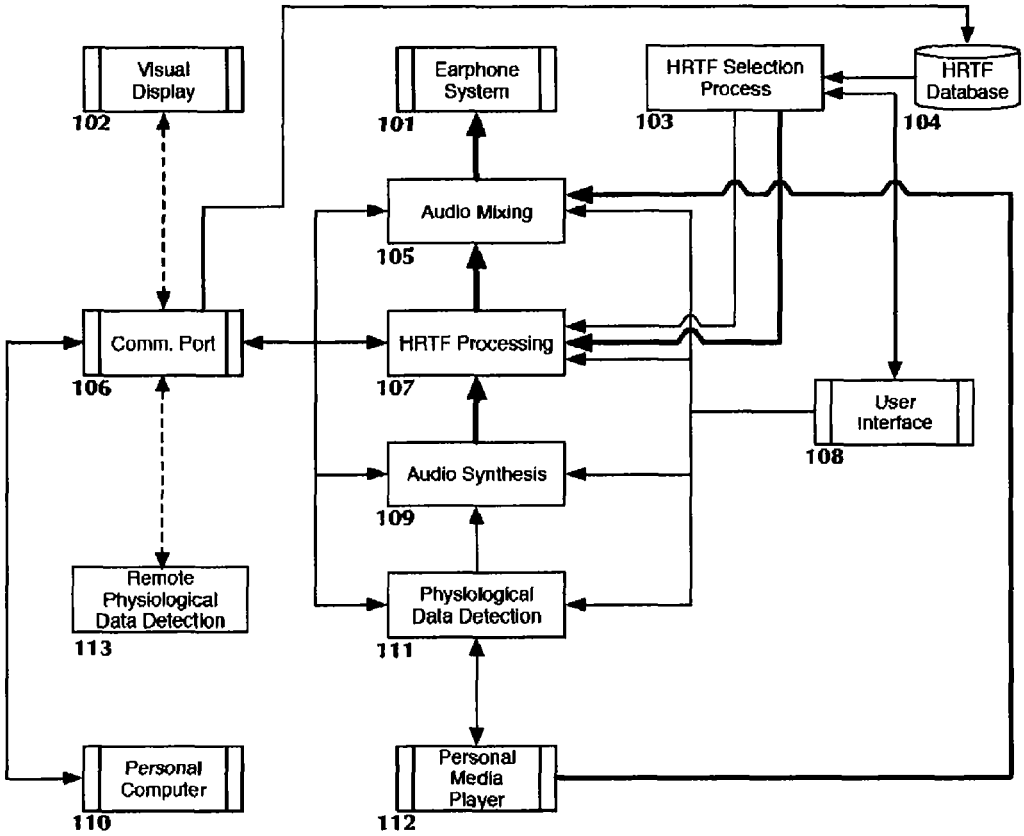
FIG. 1 is a system illustration of an exemplary embodiment of an auditory notification system.

The following description of exemplary embodiment(s) is merely illustrative in nature and is in no way intended to limit the invention, its application, or uses.

Exemplary embodiments are directed to or can be operatively used on various wired or wireless earpieces devices (e.g., earbuds, headphones, ear terminals, behind the ear devices or other acoustic devices as known by one of ordinary skill, and equivalents).

Processes, techniques, apparatus, and materials as known by one of ordinary skill in the art may not be discussed in detail but are intended to be part of the enabling description where appropriate. For example specific computer code may not be listed for achieving each of the steps discussed, however one of ordinary skill would be able, without undo experimentation, to write such code given the enabling disclosure herein. Such code is intended to fall within the scope of at least one exemplary embodiment.

Additionally exemplary embodiments are not limited to earpieces, for example some functionality can be implemented on other systems with speakers and/or microphones for example computer systems, PDAs, BlackBerry® smart phones, cell and mobile phones, and any other device that emits or measures acoustic energy. Additionally, exemplary embodiments can be used with digital and non-digital acoustic systems. Additionally various receivers and microphones can be used, for example MEMs transducers, diaphragm transducers, for example Knowles' FG and EG series transducers.

Notice that similar reference numerals and letters refer to similar items in the following figures, and thus once an item is defined in one figure, it may not be discussed or further defined in the following figures.

Example of Some Terms Used

The following examples of terms used is meant solely to aid in understanding discussions herein, and is not intended to limit the scope or meaning of the terms in any way.

Audio Synthesis System—a system that synthesizes audio signals from physiological data. The Audio Synthesis System may synthesize speech signals or music-like signals. These signals are further processed to create a spatial auditory display.

Auditory display—an audio signal or set of audio signals that convey some information to the listener through their temporal, spectral, spatial, and power characteristics. Auditory displays may be comprised of speech signals, music-like signals, or a combination of both, also referred to as auditory notifications.

Physiological data—data that represents the physiological state of an individual. Physiological data can include heart rate, blood oxygen levels, and other data.

Physiological Data Detection and Monitoring System—a system that uses sensors to detect and monitor physiological data in the user at or very near the lobule.

Remote Physiological Data Detection and Monitoring System—a system that connects through the communications port and uses sensors to detect and monitor physiological data in the user in a location remote from the invention (e.g., a pedometer device placed near the user's foot).

Sonification—the conversion of data to a music-like signal that conveys information through temporal, spectral, spatial, and/or power characteristics.

Spatial Auditory Display—an auditory display that includes spatial cues positioning audio signals in specific spatial locations. For headphone playback, this is usually accomplished using HRTF-based processing.

Summary of Exemplary Embodiments

There exist a wide variety of methods for converting physiological data into auditory displays. At least one exemplary embodiment can use sonification and/or speech synthesis as methods for generating auditory displays representing physiological data.

Sonification is the use of non-speech audio to convey information. Perhaps the most familiar example is the sonification of vital body functions during a medical operation, where the patient's heart rate is represented by a series of audible tones. A similar approach could be applied to at least one exemplary embodiment to represent heart rate data. However, in the presence of audio playback, this type of auditory display can become unintelligible because of masking and other psychoacoustic phenomenon. Speech signals tend to be more intelligible than other stimuli in the presence of broadband noise or tones, which approximate music (Zwicker, 2001). Therefore, speech synthesis methods can be implemented as well as or alternatively to sonification methods for the Audio Synthesis System.

The poorly understood but well-documented psychoacoustic phenomenon known as the "cocktail party effect" allows a listener to focus on a sound source even in the presence of excessive noise (or music). The following scenario observed in everyday life illustrates this phenomenon. Several people are engaged in lively conversation in the same room. A listener is nonetheless able to focus attention on one speaker amidst the din of voices, even without turning toward the speaker (Blauert, 1997). This effect is most dramatic with speech signals, but applies to other audio signals as well. Therefore, at least one exemplary embodiment can use speech synthesis technology, in addition to sonification technology, so that physiological data can be intelligible to the user even in the presence of audio playback, allowing the user to listen to music while selectively attending to auditory displays representing physiological data simultaneously.

Spatial unmasking is another important psychoacoustic phenomenon that is intimately related to the cocktail party effect. Put succinctly, spatial unmasking is the phenomenon where spatial auditory cues allow a listener to better monitor simultaneous sound sources when the sources are at different spatial locations. This is believed to be one of the underlying mechanisms of the cocktail party effect (Bronkhorst, 2000).

Fortunately, spatial auditory cues can be artificially imposed on audio signals using head-related transfer function (HRTF) data (U.S. Pat. No. 5,438,623). This is especially true for earphone playback. This means that with the application of HRTF-based processing, an audio signal will be perceived by the listener as a sound source occupying a specific spatial location while using stereo earphones. Spatially modulating an audio signal in this way can improve intelligibility in the presence of other audio signals (Drullman and Bronkhorst, 2000). Therefore, at least one exemplary embodiment uses HRTF technology to impose spatial auditory cues on multiple audio signal representations of various physiological data, using both speech and sonification. This facilitates the presentation of a set of spatially rich auditory displays to the end-user, conveying a plurality of physiological data simultaneously while maintaining intelligibility. U.S. patent application Ser. No. 11/751,259, filed 21 May 2007 describes HRTFs and the personalization of audio content in detail, and the content of 11/751,259 is incorporated by reference in its entirety.

At least one exemplary embodiment includes an external shell, a physiological data monitoring detection system, an Audio Synthesis System, a HRTF selection system, an HRTF-based Audio Processing System, an Audio Mixing Process, and a set of stereo acoustical transducers. The external shell system is configured in a behind-the-ear format (BTE), and can include various biometric sensors. This facilitates reasonably accurate placement of Physiological Data Monitoring Systems such as PPG sensors and appropriate placement of the acoustical transducers, with little training. The external shell system consists of either two connected pieces (i.e. tethered together by a headband) or two independent pieces fitting to the ears of the end-user.

Discussion of Exemplary Embodiments

FIG. 1 is a system illustration of an exemplary embodiment of an auditory notification system comprising: a physiological data detection system 111; the data from which can go through audio synthesis 109; with further head related transfer function (HRTF) processing 107, mixing the audio 105 (for example, from personal media player 112), and sending the result to the earpiece (e.g., earphone 101). The HRTF processing 107 can include a HRTF selection process 103 which can tap into a HRTF database 104. Data can be obtained remotely, for example remote physiological data from remote detection 113, where the information can be obtained via a remote system (e.g., personal computer 110) via a communication port 106, all of which can be displayed to a user via visual display 102. User interface 108 may be used to control one or more of HRTF selection process 103, physiological data detection 111, audio synthesis 109, HRTF processing 107 and audio mixing 105.

Figure 2:
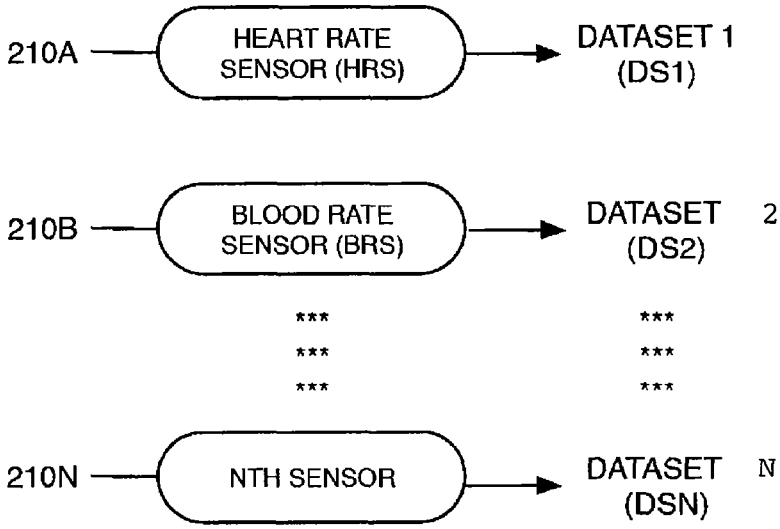
FIG. 2 illustrates various sensors generating measured datasets in a given time increment.

FIG. 2 illustrates various sensors generating measured datasets in a given time increment. Various sensors (e.g., 210A, 210B, 210N) can be used in an exemplary embodiment for generating sensor data (e.g., biometric data such as heart rate values, blood pressure values, and any other biometric data, and other types of data such as UV dose obtained, temperature, humidity, or any other sensor data that can measure as known by one of ordinary skill in the relevant arts). The first sensor 210A generates a first data set 1 (DS1) of measured data in a given time AT. Likewise the second sensor 210B generates a second data set DS2, and so forth to the final sensor activated, the Nth sensor.

Figure 3:
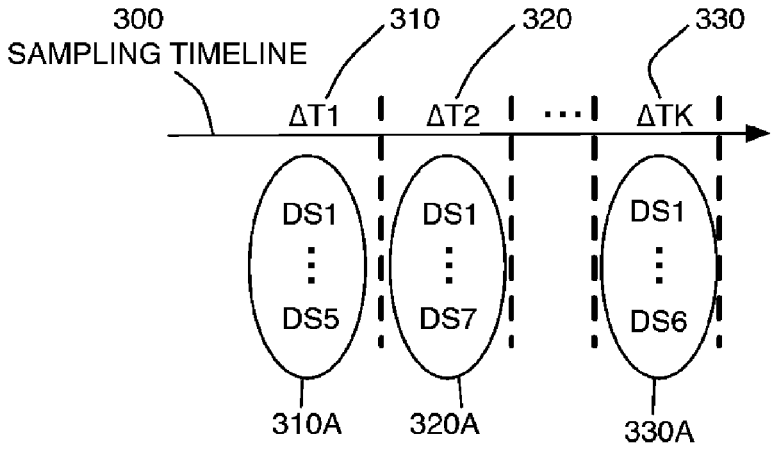
FIG. 3 illustrates a non-limiting example of a sampling timeline where a different number of sensors can be measuring a different set of datasets for a given time increment.

FIG. 3 illustrates a non-limiting example of a sampling timeline 300 where a different number of sensors can be measuring a different set of datasets for a given time increment. During different time increments (e.g., 310, 320, 330), various sensors can be activated, and thus the total number of datasets per time increment can change. For example for the first time increment 310, five sensors are activated generating five sets of data sets DS1 . . . DS5 (e.g., 310A). Likewise for the second and last time increments, 320 and 330 respectively, seven and six sensors have been activated and are generating data sets (e.g., 320A and 330A). Thus during each time increment (also referred to as a sampling epoch), a various number of data sets can be generated.

Figure 4:
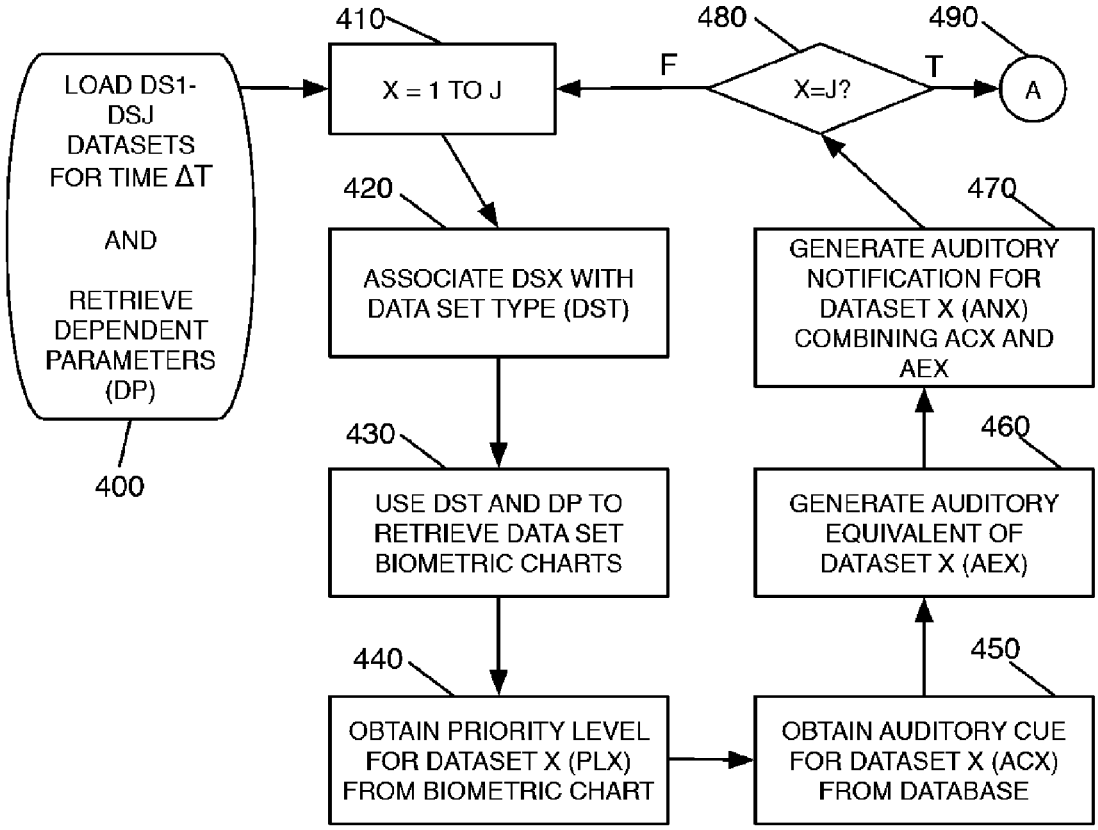
FIG. 4 illustrates a method of generating an auditory notification for a given data set in accordance with at least one exemplary embodiment.

FIG. 4 illustrates a method of generating an auditory notification for a given data set in accordance with at least one exemplary embodiment. Once a set of data sets has been generated for a given sampling epoch, the data sets are loaded, and the dependent parameters (DP) retrieved, 400. The DP can include variables relevant to medical history (e.g., age, sex, heart history, blood pressure history), limits set on biological systems (e.g., a high temperature value allowed, a low temperature value allowed, a high pressure allowed, a low pressure allowed, a high oxygen content allowed, a low oxygen content allowed, UV dose values allowed) or any other data that can influence the biometric curves used to obtain priority levels, or threshold values for sending notification. In the example illustrated, "j" datasets were generated for the sampling epoch, thus an auditory notification (AN) can be generated for each dataset. An xth data set (DSX) is loaded from the set of data sets 410. The type of data set is determined by comparing either a data set identifier in the data set, or comparing the data set units with a database to obtain the data set type (DST), 420. The DST and DP are used to select a unique (e.g., if age varies the biometric chart may vary in line shape) biometric chart from a database, 430. The measured value of the data set (MVDS), for example it can be the average value over the sampling epoch, or the largest value over the sampling epoch, is found on the biometric chart and a priority level PLX obtained, 440. The type of dataset can be associated with an auditory cue (e.g., short few bursts of tones to indicate heart rate data), and thus the auditory cue for the xth dataset (ACX) can be obtained (e.g., from a database), 450. The xth data set can also be converted into an auditory equivalent of the xth dataset (AEX) 460 (e.g., periodic beeps associated with a heart rate, with temporal spacing dependent upon the heart rate in the sampling epoch). An auditory notification (AN) can then be generated 470 by combining the ACX with the AEX to generate an auditory notification for the xth dataset (ANX). For example ANX can be a first auditory part comprised of the ACX followed by the AEX. After step 480, it is determined whether the xth data set is the jth (last) data set. If the jth data set is reached, step 480 proceeds to step 490 and the process is complete. If the jth data set is not reached, step 480 proceeds to step 410 and the process is repeated at steps 410-480 for the next data set.

Figure 5:
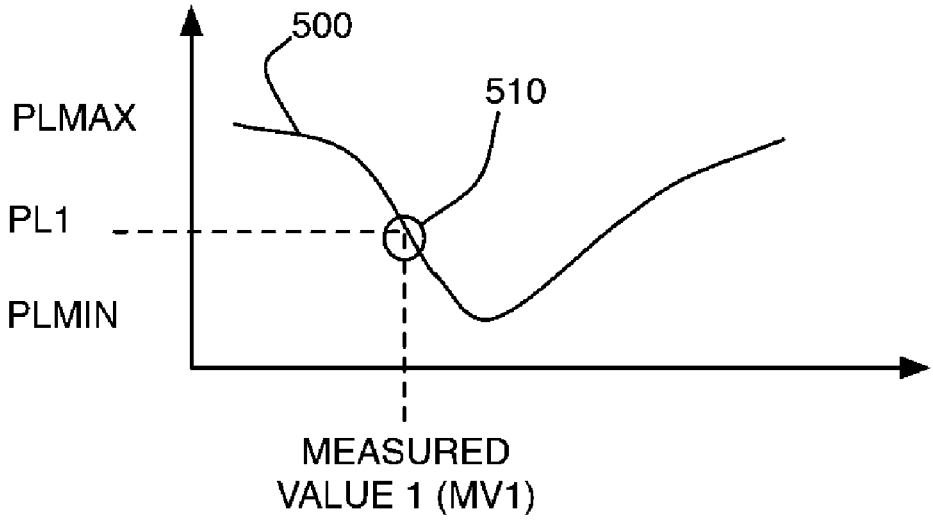
FIG. 5 illustrates a first example of a biometric chart, which can depend on dependent parameters (e.g., age, sex), where the priority level associated with a measured data set value can be obtained from the chart.

FIG. 5 illustrates a first example of a biometric chart, which can depend on dependent parameters (e.g., age, sex), where the priority level associated with a measured data set value can be obtained form the chart. The biometric line 500 can vary with dependent parameter, as mentioned above. In this non-limiting example, a measured value 1 (MV1) from the first dataset is used to obtain a priority level 1 (PL1) 510, associated with MV1.

Figure 6:
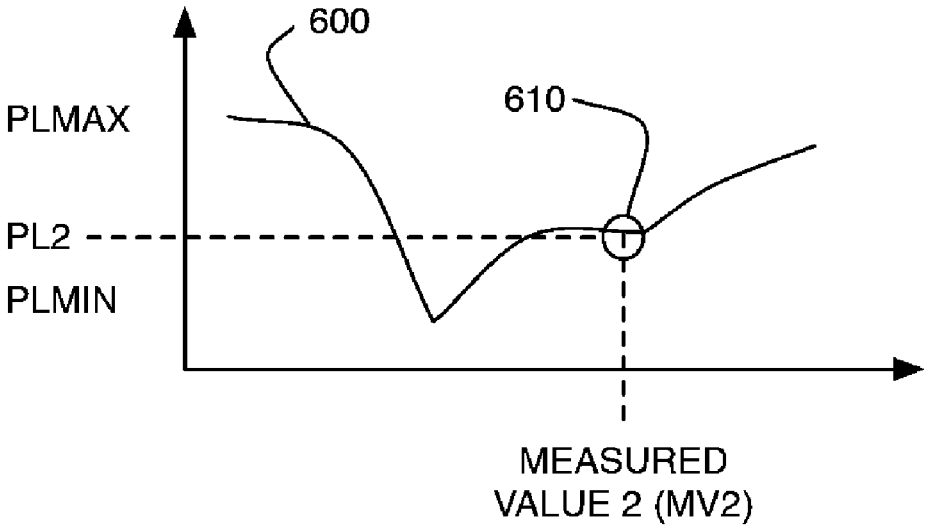
FIG. 6 illustrates a second example of a biometric chart, which can depend on dependent parameters (e.g., cholesterol, medical history), where the priority level associated with a measured data set value can be obtained from the chart.

FIG. 6 illustrates a second example of a biometric chart, which can depend on dependent parameters (e.g., cholesterol, medical history), where the priority level associated with a measured data set value can be obtained from the chart. The biometric line 600 can vary with dependent parameter, as mentioned above. In this non-limiting example, a measured value 2 (MV2) from the first dataset is used to obtain a priority level 2 (PL2) 610, associated with MV2. Note that MV1 and MV2 can have different PL values PL1 and PL2. Thus when ranked the data sets can be ranked by PL values. The biometric charts can have a PLmax and a PLmin value. For example if all of the biometric charts are normalized, PLMAX can be 1.0, and PLMIN can be 0.

Figure 7:
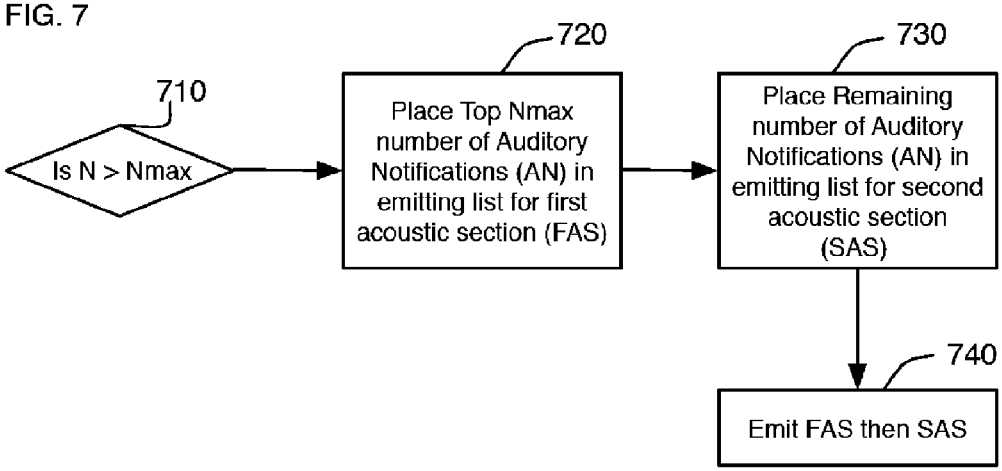
FIG. 7 illustrates a method of breaking up a set of auditory notification signals into multiple emitting sets that can be emitted in serial in accordance with at least one exemplary embodiment.

FIG. 7 illustrates a method of breaking up a set of auditory notification signals into multiple emitting sets than can be emitted in serial in accordance with at least one exemplary embodiment. If the number of datasets is larger than a selected number Nmax (e.g., the number than can be usefully distinguishable to a user, e.g., 5), then the number of auditory notifications (AN), N, can be broken into multiple serial sections, each containing a sub-set of the N auditory notifications. For example the first N can be compared with Nmax, 710. If greater than the top Nmax sub set of N ANs can be put into a first acoustic section (FAS) of an emitting list, 720. The remaining subsets of ANs can be placed into a second acoustic section (SAS) of an emitting list, 730, and more if needed. The ANs in the emitting list are sent for emitting in a serial manner where the ANs in the FAS are emitted first, then the ANs in the SAS are emitted next and so on, until all N ANs are emitted, 740.

Figure 8:
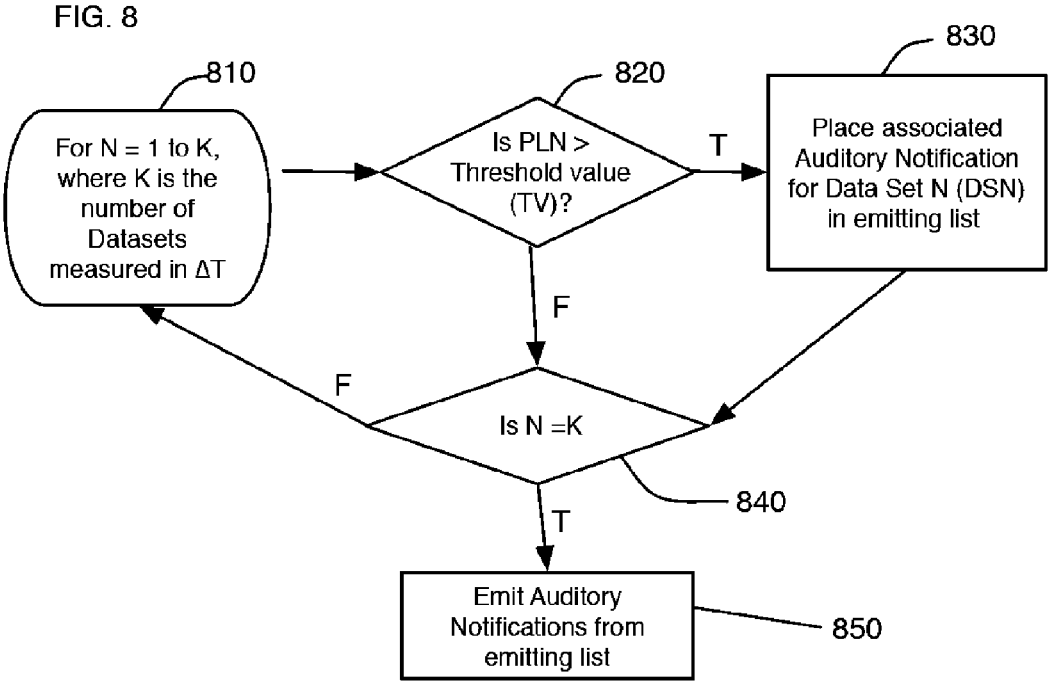
FIG. 8 illustrates a first method for generating an emitting list of auditory notification signals.

FIG. 8 illustrates a first method for generating an emitting list of auditory notification signals. When a dataset is generated, the associated AN may not be emitted if it doesn't rise to a certain priority level (e.g., if normalized 0.5). For example, one can sample the nth data set in a k number of datasets in sampling epoch, 810. The Priority Level associated with the nth dataset (PLN) can be compared to a threshold value (TV) 820 (e.g., 9, 0.5, 85%) and if the PLN is greater than TV the AN associated with the dataset is added to the emitting list 830. If PVN is less than or equal to TV then the next data set's PL value is loaded and compared with TV until one has gone through all k datasets. Thus if N=K, 840, the ANs in the emitting list are emitted to the user, 850.

Figure 9:
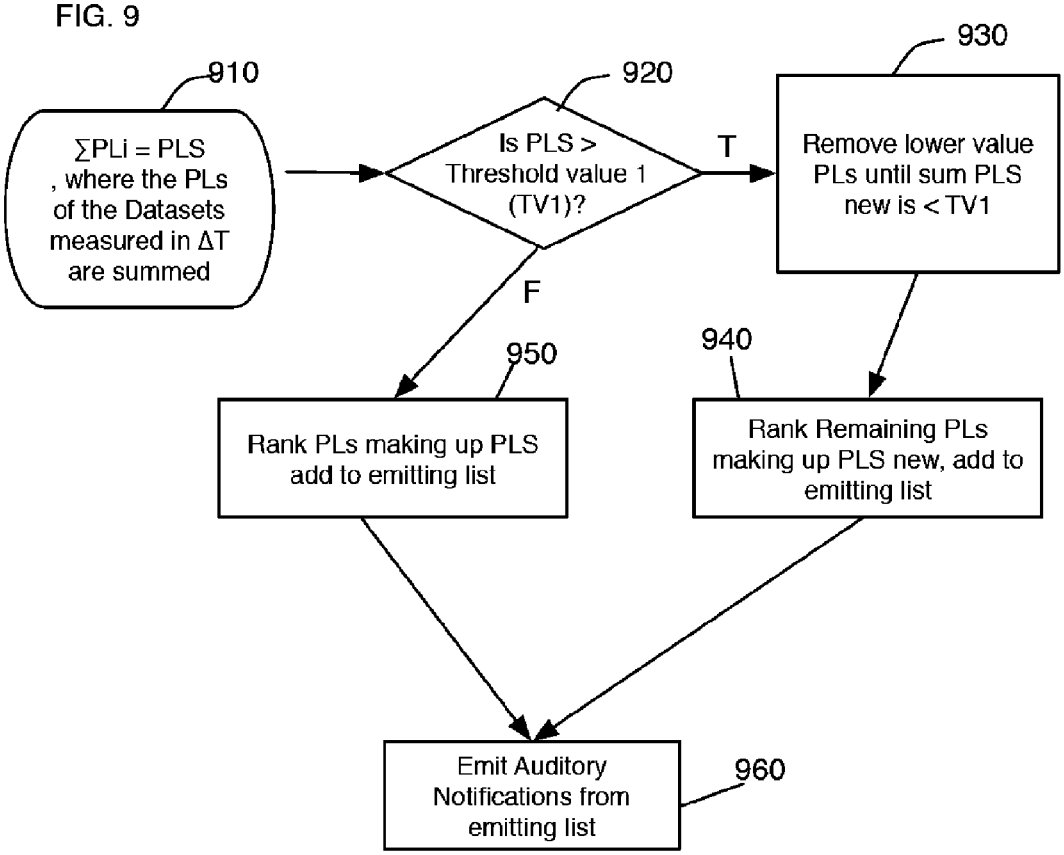
FIG. 9 illustrates a second method for generating an emitting list of auditory notification signals.

FIG. 9 illustrates a second method for generating an emitting list of auditory notification signals. Another method of generating an emitting list according to priority level is to sum all of the PLs of the datasets, 910, generating a value PLS. PLS is then compared to a threshold value, TV1, 920 (e.g., 2.5, if there are five data sets in sampling epoch). If PLS is greater than TV1, then the data set with the lowest PL value is removed from a sum list, 930. The remaining PLs in the sum list can be ranked from highest value to lowest value 940, a new PLS calculated and compared to TV1, with this process continuing until PLS new is less than TV1, the remaining PLs and associated ANs are added to the emitting list. If the initial PLS is less than or equal to TV1, then the ANs are added directly to the emitting list, 950. The emitting list is then sent for emitting to the user, 960.

Additional Examples of Exemplary Embodiments

In at least one exemplary embodiment the Physiological Data Monitoring System is implemented inside the external shell system, usually on the end-user's lobule. This facilitates the implementation of a PPG sensor as part of the Physiological Data Monitoring System. Similarly, pulse oximetry technology or ultrasound systems, pulse oximeter, skin temperature, ambient temperature, galvanic skin sensor by example can be implemented. Any appropriate non-invasive physiological data-detection device (sensor) can be implemented as part of at least one exemplary embodiment of the present invention.

In further exemplary embodiments, an external pedometer device provides additional physiological data. Any pedometer system familiar to those skilled in the art can be used. One example pedometer system uses an accelerometer to measure the acceleration of the user's foot. The system accurately calculates the length of each individual stride to derive a total distance calculation (e.g., U.S. Pat. No. 6,145,389).

In at least one exemplary embodiment the Audio Synthesis System facilitates the conversion of physiological data to auditory displays. Any processing of physiological data takes place as an initial step of the Audio Synthesis System. This includes any calculations related to the end-user's target heart rate zones, AT, or other fitness related calculations. Furthermore, other physiological data can be highlighted that relate to particular problems encountered during physical therapy, where recovery of normal function is the focus of the exercise. In the Audio Synthesis System, physiological data can undergo sonification, resulting in musical audio signals that convey physiological information through their spectral, spatial, and temporal characteristics. For example the user's current heart rate and/or target heart rate zone could be represented by a series of audible pulses where the time between pulses conveys heart rate information. Also, the user's heart rate with respect to time could be represented by a frequency swept sinusoid or other tone followed by a brief period of silence.

For example, the frequency of the tone would increase with a duration and range corresponding to the increase over time of the user's heart rate. A wide variety of approaches to the sonification of physiological data could be implemented by the Audio Synthesis System, including parameter mapping and model-based sonification (Kramer, et al, 1999).

In the Audio Synthesis System, physiological data may also be processed by a speech synthesis system, which converts physiological data into speech signals. For example, the user's current heart rate and/or target heart rate zone could be indicated in beats-per-minute (BPM) by numerical speech signals. The Audio Synthesis System can be applied to a plurality of physiological data, using any combination of sonification and speech synthesis, resulting in a plurality of audio signals that constitute the designed auditory displays.

These audio signals can then sent to the HRTF-based Audio Processing System, which uses a set of HRTF data and mapping to assign a plurality of auditory displays to unique spatial locations. The auditory displays are processed using the corresponding HRTF data and submitted to an Audio Mixing Process, usually producing a stereo audio mix presenting spatially modulated auditory displays. Returning to the example discussed above, it should be clear that a great deal of information could be simultaneously presented from distinct locations. For example, the user's current heart rate and/or target heart rate zone could be indicated in beats-per-minute (BPM) by numerical speech signals delivered from a location slightly to the right, while, the user's stride, as measured by a pedometer, could be heard simultaneously by the user at a completely unique spatial location. Any set of HRTF data may be used including generic, semi-personalized, or personalized HRTF data (Martens, 2003).

As a compliment to the HRTF Processing System, an HRTF Selection System is included in the present invention. This system aids the end-user to select personally, or to be provided with, a "best-fitting" set from a database of HRTF data sets. A test routine allows the end-user to subjectively evaluate the effectiveness of any HRTF data set by listening to a series of spatially modulated audio signals. The end-user then selects the HRTF data set that provides the most convincing three-dimensional sound field. In another iteration, the user's personalized HRTF data can be sent electronically via a communications system, obviating the need to select from a generic or semi-personalized HRTF data set. While this HRTF selection process is described by the exemplary embodiments within, any HRTF selection or acquisition process could be implemented in conjunction exemplary embodiments.

The spatially modulated auditory displays from the HRTF-based Audio Processing System can then be sent to an Audio Mixing Process. Here, the auditory displays can be combined with other audio playback from an internal media player device included with the system or an external media player device such as a personal music player.

The auditory displays can be mixed with audio playback in such a way that the auditory displays are clearly audible to the end-user. Therefore a method for monitoring the relative volume of all audio inputs is implemented. This insures that each auditory display is heard at a level that is sufficiently loud relative to any audio playback. The output of the Audio Mixing Process can be sent to the earphone system where the audio signals are reproduced as acoustic waves to be auditioned by the end-user. The system includes a digital-to-analog converter, a headphone preamplifier, acoustical transducers, and other components typical of earphone systems.

Further exemplary embodiments also include a communications port for interfacing with some host device (i.e. a personal computer). Along with supporting software executed on the host device, this aids the end-user to change operational settings of any device of the exemplary embodiments. Also, new HRTF data may be provided to the HRTF Processing System and any system updates may be installed. Also, a variety of user preferences or system configurations can be set in the present invention through a personal computer interfacing with the communications port.

Furthermore, the communications port allows the end-user to transmit physiological data to a personal computer for additional analysis and graphical display. This functionality would be useful in a number of fitness training scenarios, allowing the user to track his/her progress over many workout sessions.

Similarly, exemplary embodiments can inform the user about statistics, trends, dates, times, and achievements related to previous workout sessions through the auditory display mechanism. Calculations related to such information can be carried out by exemplary embodiments, supporting software on a personal computer, or any combination thereof.

In further exemplary embodiments, the communications port enables communications with a media player device such as a personal music player. This embodiment speaks to a system in which the user's physiological data are used to modulate musical pitch, tempo, or selection rather than physically control these functions with a manual mechanical operation. This device can be an external device or it can be included as part of an exemplary embodiment. Audio playback from the media player device can be modulated in pitch, tempo, or otherwise to correspond with physiological data detected by sensors of the exemplary embodiments. Furthermore, audio files can be automatically selected based on meta data describing the audio files and the physiological data detected by the present invention. For example, if the user's heart rate is found to be steadily increasing by the Physiological Data Monitoring System, an audio file with a tempo slightly higher than that of the current audio playback could be selected.

Further exemplary embodiments can be mounted in a pair of eyeglass frames that sit on the user's ears similar to BTE hearing aid devices. These eyeglass frames may support other technology such as semi-transparent visual displays. Other exemplary embodiments can provide visual information in any number of ways, such as small visual displays situated on wristbands, or attached to belts, or placed upon the floor.

At least one exemplary embodiment is directed to a fitness aid and rehabilitation system for converting various physiological data to a plurality of spatially modulated auditory displays, the system comprising: an external shell that fits around the ear of the user; a Physiological Data Detection and Monitoring System for monitoring various physiological data in the end-user; an Audio Synthesis System for converting physiological data into a plurality of auditory displays; an HRTF-based Audio Processing System for applying HRTF data to a plurality of auditory displays such that each auditory display is perceived as occupying a unique spatial location; an HRTF Selection System allowing the end-user to select the "best-fitting" set from a plurality of HRTF data sets; an HRTF data set which can be imported; an Audio Mixing System for combining spatially modulated auditory displays with an audio playback stream, e.g. the output of a personal media player; an earphone system with stereo acoustical transducers for reproducing audio signals as acoustic waveforms; a communication system to a PC; and a PC registration/set-up screen for entering certain personal data (e.g., dependent parameters such as age, sex, height, weight, cholesterol level).

In at least one exemplary embodiment the Physiological Data Detection and Monitoring system can further comprise any combination of the following: a PPG (photoplethysmography) sensor system to monitor heart rate, pulse waveform, and other physiological data non permanently attached to the end-user's lobule; any physiological sensor technology familiar to those skilled in the art; a remote sensor to be attached to the user for Physiological Data Detection and Monitoring. These sensors may include, pulse oximeter, skin temperature, ambient temperature, galvanic skin sensor as examples.

In at least one exemplary embodiment the audio synthesis system can further comprise any combination of the following: a method of sonification of physiological data from the Physiological Data Detection and Monitoring System; a speech synthesis method for converting physiological data from the physiological monitoring system to speech signals; a digital signal processing (DSP) system to support the above-mentioned processes; and a method for assigning intended spatial locations to each of the synthesized audio signals, and passing the location specification data onto the HRTF-based Audio Processing System.

In at least one exemplary embodiment the HRTF-based Audio Processing System further comprises: a set of HRTF data that can be generic, semi-personalized, or personalized; a plurality of HRTF data representing a plurality of spatial locations around the listener's head; a system for the application of HRTF data to an audio input signal such that the resulting audio output signal (usually a stereo audio signal) contains a sound source that is perceived by the listener as originating from a specific spatial location (usually implemented on a DSP system); and a setup process to optimize the spatial locations for the individual users.

In at least one exemplary embodiment the HRTF Selection System further comprises: a database system of known HRTF data sets; a method for testing the effectiveness of a given set of HRTF data by processing a test audio signal with the set of HRTF data and presenting the resulting spatially modulated test audio signal to the user, the user can compare test audio signals processed with different HRTF data sets and select the data set that provides the best three-dimensional sound field; a method for electronically importing the user's personalized HRTF data via a communications system into the HRTF Database.

In at least one exemplary embodiment the Audio Mixing System further comprises: a set of digital audio inputs from the HRTF-based Audio Processing System for accepting the spatially modulated auditory displays; a set of analog audio inputs and corresponding Analog to Digital Converter (ADCs) for accepting audio inputs for playback from external devices, such as personal media players; a set of digital audio inputs for accepting audio playback from external devices, such as personal media players; a method for monitoring the level of all audio inputs; and a DSP system for mixing all audio inputs at appropriate levels.

In at least one exemplary embodiment the earphone system further comprises: a headphone preamplifier, acoustical transducers, and other components typically found in headphone systems; and an audio input from the audio mixing system.

At least one exemplary embodiment includes a communication port for interfacing with a personal computer or some other host device, the system further comprising: a communications port implementing some appropriate communications protocol; some supporting software executed on the host device (i.e. personal computer); a method for supplying new sets of HRTF data to the HRTF processing system through the communications port; a method for modifying parameters of the audio synthesis system through the communications port to reflect end-user preferences or system updates; a method for modifying parameters of the Physiological Data Detection and Monitoring and Monitoring system through the communications port to reflect end-user preferences or system updates; and a method for modifying parameters of the audio mixing system through the communications port to reflect end-user preferences or system updates.

In at least one exemplary embodiment the communications port is used to interface with a media player device such as a personal media player to achieve any combination of the following: modulation of audio playback based on the detection of physiological data, where modulation can include modifying the tempo or pitch of audio playback to correspond with physiological data such as heart rate; and selection of audio content for audio playback based on meta data describing the audio content and the detection of physiological data. For example, if the user's heart rate is found to be steadily increasing, an audio file with a tempo slightly higher than that of the current audio file would be selected.

At least one exemplary embodiment can include a visual display which can be mounted in a pair of eyeglass frames that sit on the user's ears similar to BTE hearing aid devices, or situated on wristbands, or attached to belts, or placed upon the floor. This visual display can achieve any combination of the following: visual display of system control information to facilitate the user's selection of device modes and features; visual display supporting selection of audio content for audio playback; visual display supporting selection of physiological data that should be emphasized for auditory display via level and/or spatial location at which to present the audio signal produced by sonification of the physiological data.

At least one exemplary embodiment provides the end-user with fitness-related information that gives them feedback for maintaining their general bodily health. The associated auditory and/or visual display can be used in any of the following non-limiting ways: the maintenance of key physiological levels during a given exercise, such as heart rate for cardiovascular conditioning; and the review of the end-user's previously collected physiological data for the user either before or after an exercise session (i.e., accessing the end-user's work out history).

In at least one exemplary embodiment the auditory and/or visual display can aid the end-user in any of the following non-limiting ways: the reaching of goals during a given exercise related to a specific rehabilitation, such as recovery of leg muscular function after knee surgery; and the review of the end-user's previously collected physiological data for the user either before or after an exercise session (i.e., accessing the end-user's physical therapy history).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions of the relevant exemplary embodiments Thus, the description of the invention is merely exemplary in nature and, thus, variations that do not depart from the gist of the invention are intended to be within the scope of the exemplary embodiments of the present invention. Such variations are not to be regarded as a departure from the spirit and scope of the present invention.

What is claimed is:

1. A method of auditory communication comprising:

measuring physiological data from at least one sensor to form a plurality of data sets;

identifying a type of each of the plurality of data sets;

associating the respective plurality of data sets with a plurality of priority levels;

identifying a respective auditory cue associated with each type of the plurality of data sets;

generating a plurality of auditory notifications based on the plurality of data sets and each respective auditory cue by converting each of the plurality of data sets into at least one of a speech signal using speech synthesis or a non-speech audio signal conveying at least one of a temporal characteristic, a spectral characteristic, a spatial characteristic or a power characteristic of the physiological data;

organizing the plurality of auditory notifications according to an order of the plurality of priority levels to form an auditory notification list;

associating the plurality of auditory notifications with different spatial locations relative to a user; and simultaneously presenting a sub-set of the plurality of auditory notifications having a priority level above a threshold value to the user via an earphone system according to the associated spatial locations.

2. The method according to claim 1, further comprising:

for at least one of the data sets, generating an auditory equivalent of the respective data set, where the corresponding auditory notification is a combination of the auditory cue and the auditory equivalent.

3. The method according to claim 1, where the sub-set is chosen from among the auditory notifications in the auditory notification list according to a number of auditory notifications allowed to be emitted.

4. The method according to claim 1, where at least one of the data sets includes operational data.

5. The method according to claim 1, where at least one of the data sets includes diagnostic data.

* * * * *

UNITED STATES PATENT AND TRADEMARK OFFICE

CERTIFICATE OF CORRECTION

PATENT NO. : 8,326,628 B2
APPLICATION NO. : 13/012047
DATED : December 4, 2012
INVENTOR(S) : Steven Wayne Goldstein, John Usher and John Patrick Keady It is certified that error appears in the above-identified patent and that said Letters Patent is hereby corrected as shown below:

On the cover page, Item (54) and at Column 1, lines 1 and 2, Title: "METHOD OF AUDITORY DISPLAY OF SENSOR DATA" should be --METHOD OF GENERATING AN AUDITORY RESPONSE TO PHYSIOLOGICAL SENSOR DATA--

Signed and Sealed this
Twelfth Day of February, 2013

Teresa Stanek Rea
*Acting Director of the United States Patent and Trademark Office*